US007743440B2

(12) United States Patent
Burnett

(10) Patent No.: US 7,743,440 B2
(45) Date of Patent: Jun. 29, 2010

(54) BED WITH AUTOMATIC MATTRESS LIFTING SYSTEM

(76) Inventor: John A. Burnett, 6000 Anderson County Rd. 448, Palestine, TX (US) 75803

( * ) Notice: Subject to any disclaimer, the term of this patent is extended or adjusted under 35 U.S.C. 154(b) by 50 days.

(21) Appl. No.: 12/081,032

(22) Filed: Apr. 9, 2008

(65) Prior Publication Data

US 2009/0255056 A1 Oct. 15, 2009

(51) Int. Cl.
*A47C 19/00* (2006.01)

(52) U.S. Cl. ..... 5/11; 5/200.1; 5/488

(58) Field of Classification Search ..... 5/11, 5/611, 612, 200.1, 634, 640, 509.1, 488
See application file for complete search history.

(56) References Cited

U.S. PATENT DOCUMENTS

| | | | | | |
|---|---|---|---|---|---|
| 1,009,442 | A | | 11/1911 | Schwab | |
| 2,527,111 | A | * | 10/1950 | Widrich | 5/611 |
| 2,620,491 | A | | 12/1952 | Allport | |
| 3,516,097 | A | * | 6/1970 | Angus | 5/412 |
| 3,887,950 | A | * | 6/1975 | Wachsman | 5/11 |
| 3,987,503 | A | | 10/1976 | Kean | |
| 4,006,499 | A | | 2/1977 | Young | |
| 4,344,195 | A | | 8/1982 | Gustafson | |
| 4,402,097 | A | * | 9/1983 | Scott | 5/181 |
| 4,999,864 | A | | 3/1991 | Crews | |
| 5,758,372 | A | * | 6/1998 | Lopez Diaz | 5/200.1 |
| 6,061,852 | A | * | 5/2000 | Bathrick et al. | 5/618 |
| 6,505,362 | B1 | * | 1/2003 | Scipio | 5/118 |
| 6,941,594 | B1 | | 9/2005 | Mosley | |
| 2005/0251915 | A1 | | 11/2005 | Elizondo | |
| 2005/0251916 | A1 | * | 11/2005 | Elizondo | 5/611 |
| 2007/0256240 | A1 | | 11/2007 | Regev et al. | |

FOREIGN PATENT DOCUMENTS

| | | |
|---|---|---|
| FR | 2584283 | 1/1987 |

* cited by examiner

*Primary Examiner*—Peter M. Cuomo
*Assistant Examiner*—William Kelleher
(74) *Attorney, Agent, or Firm*—Richard C. Litman

(57) ABSTRACT

The bed with automatic mattress lifting system is a bed with a frame and an internal drive system for raising a mattress above the frame, allowing the user to easily change the sheets or other bed coverings. The mattress rests on a mattress supporting platform, which, in the lowered position, is received within the frame. In operation, driven motion of an internal rod caused by a drive system located within the frame generates rotation in a lever arm. The lever arm is secured to a shaft that extends across the frame, and rotation of the shaft causes a pair of supports to rotate. Upper ends of the supports are joined to a lower surface of the mattress supporting platform, thus driving upward movement of the mattress supporting platform. The sheets cover both the mattress and the platform, allowing the sheets to be changed without having to manually lift the mattress.

18 Claims, 5 Drawing Sheets

BED WITH AUTOMATIC MATTRESS LIFTING SYSTEM

BACKGROUND OF THE INVENTION

1. Field of the Invention

The present invention relates to furniture and furnishings, and particularly to a bed with an automatic mattress lifting system that allows the user to easily change the sheets or other bed coverings thereof.

2. Description of the Related Art

Making a bed, including changing sheets and other bedding, can be a difficult process, particularly for the infirm, elderly or disabled. Typically, sheets and blankets must be removed and then replaced with new sheets and blankets, requiring the raising of the mattress from the bed frame or box spring. The old bedding is pulled away from the box spring and mattress, and the edges and corners of the new bedding are inserted between the box spring and mattress.

For those who are incapable of easily lifting the mattress in order to change the bedding, it would be desirable to provide an automatic lifting mechanism for the mattress, which removes the necessity for the mattress to be manually lifted from the frame or box spring. Thus, a bed with an automatic mattress lifting system solving the aforementioned problems is desired.

SUMMARY OF THE INVENTION

The bed with automatic mattress lifting system is a bed with a frame and an internal drive system for raising the mattress of the bed above the frame, allowing the user to easily change the sheets or other bed coverings thereof. The bed with the automatic mattress lifting system includes a frame defining an open interior region therein and a mattress supporting platform having opposed upper and lower surfaces, with the upper surface being adapted for supporting the mattress.

At least one first support having opposed upper and lower ends is provided, with the upper end thereof being pivotally joined to the lower surface of the mattress supporting platform. At least one second support having opposed upper and lower ends is also provided, with the upper end thereof also being pivotally joined to the lower surface of the mattress supporting platform.

First and second shafts, each extending along a lateral direction within the open interior region of the frame, are further provided, with each shaft being rotatably secured to the frame. The lower end of the at least one first support is secured to the first shaft and the lower end of the at least one second support is secured to the second shaft.

A user-actuatable drive system is mounted within the frame, which may be a motor, a hydraulic system, a pneumatic system or the like. A rod is linked to the user-actuatable drive system and is driven thereby. Preferably, the at least one first support includes a pair of first supports, and the at least one second support includes a pair of second supports. The pairs of first and second supports are respectively positioned adjacent pairs of laterally opposed ends of the first and second shafts. The user-actuatable drive system and the rod are preferably positioned substantially laterally central with respect to the first and second shafts. A controller is preferably in communication with the user-actuatable drive system and an external source of power.

A lever arm having opposed first and second ends is further provided, with the first end being secured to the second shaft and the second end being pivotally secured to the rod. In operation, driven motion of the rod causes the lever arm to rotate, thus driving rotation of the second shaft, and rotation of the second shaft causes the pair of second supports to rotate, thus driving upward movement of the mattress supporting platform.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
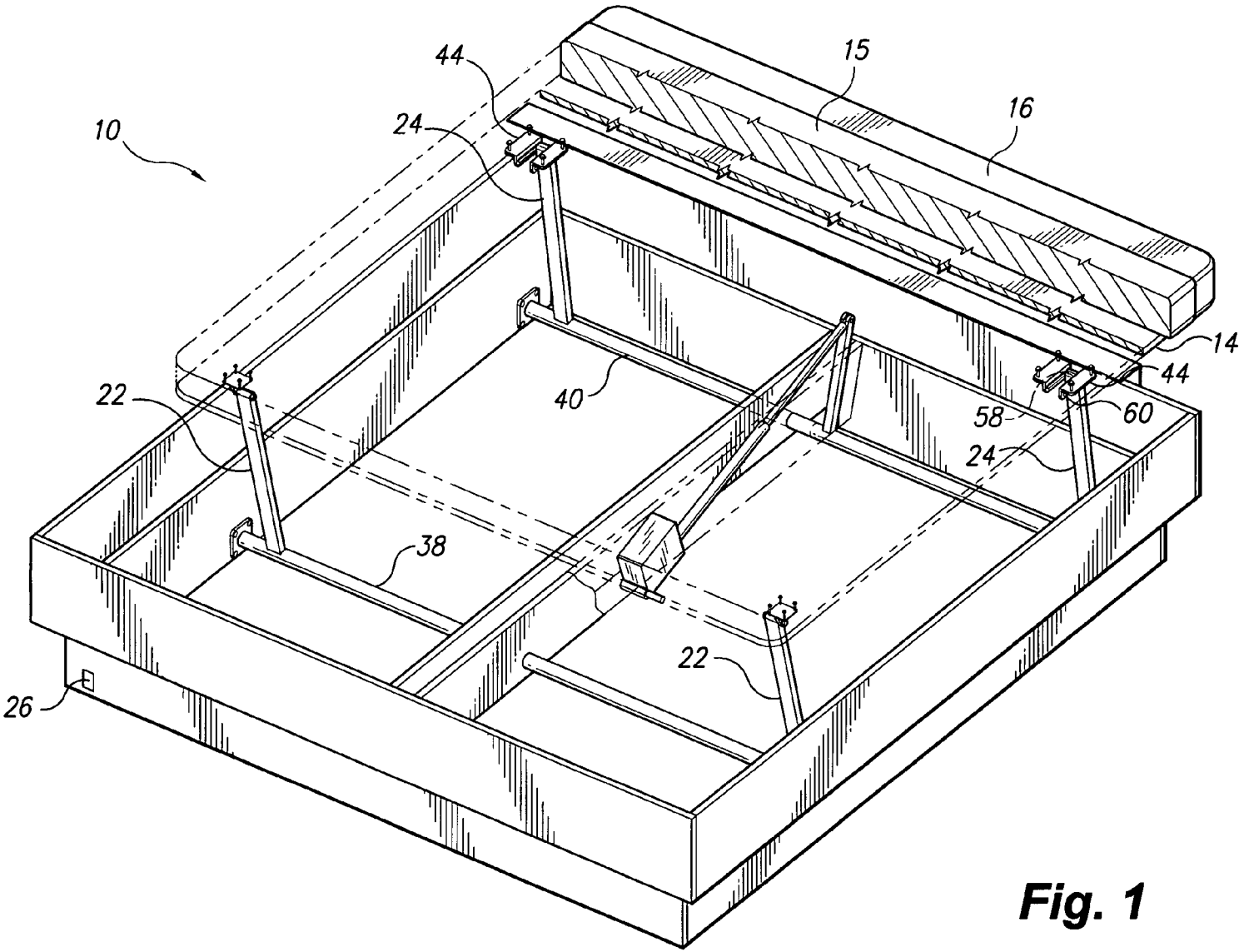
FIG. 1 is a perspective view of a bed with an automatic mattress lifting system according to the present invention.

The present invention is directed towards a bed with an automatic mattress lifting system 10. As shown in FIG. 1, the bed 10 includes a frame 12 with an internal drive system for raising the mattress 15 of the bed 10 above an upper edge of the frame 12, allowing the user to easily change the sheets 16 or other bed coverings thereof. The mattress 15 and sheet 16 are shown for exemplary purposes only and the system 10 may be applied to any suitable form of bedding.

The bed with the automatic mattress lifting system 10 includes frame 12 defining an open interior region, and a mattress supporting platform 14 having opposed upper and lower surfaces, with the upper surface being adapted for supporting the mattress 15. As shown in FIG. 1, fitted sheet 16 covers not only mattress 15, but also the platform 14, thus allowing the sheet 16 to be removed without manually lifting mattress 15.

The frame 12 preferably includes upper and lower portions 34, 36, respectively, with a lower edge of the upper portion 34 extending beyond an upper edge of the lower portion 36. In the lowered position (shown in FIG. 3), the mattress supporting platform 14 rests on the upper edge of the lower portion 36 within the open interior region of the frame 12. Preferably, a padded layer 56 is formed on the upper edge of the lower portion 36. The padded layer 56 may be formed from rubber, foam, foam rubber or the like, and prevents damage to the platform 14 while also reducing the risk of injury to the user if the user's hand becomes trapped between the lower portion 36 and the platform 14. The padded layer also increases the frictional force, allowing for the frame to better grip the bedding, and also aids in preventing wear on the fabric of the bedding. The upper and lower portions 34, 36 preferably have substantially rectangular cross-sectional shapes, although it should be understood that the bed 10 may have any desired dimension and configuration.

At least one first support 22 having opposed upper and lower ends is provided, with the upper end being pivotally joined to the lower surface of the mattress supporting platform 14. The upper end may be pivotally secured through the use of any suitable pivotal attachment, such as a pivot rod or the like. At least one second support 24 having opposed upper and lower ends is also provided, with the upper end also being pivotally joined to the lower surface of the mattress supporting platform 14. Supports 22, 24 may be formed from metal or any other suitable rigid material capable of supporting the weight of the mattress 15 and platform 14. Preferably, at least one bracket 44 is secured to the lower surface of the mattress supporting platform 14. The bracket 44 has a slot 58 formed therethrough and the upper end of the second support 24 has a complementary projecting member 60 formed thereon, with the projecting member 60 being slidably and pivotally received within the slot 58.

Figure 2:
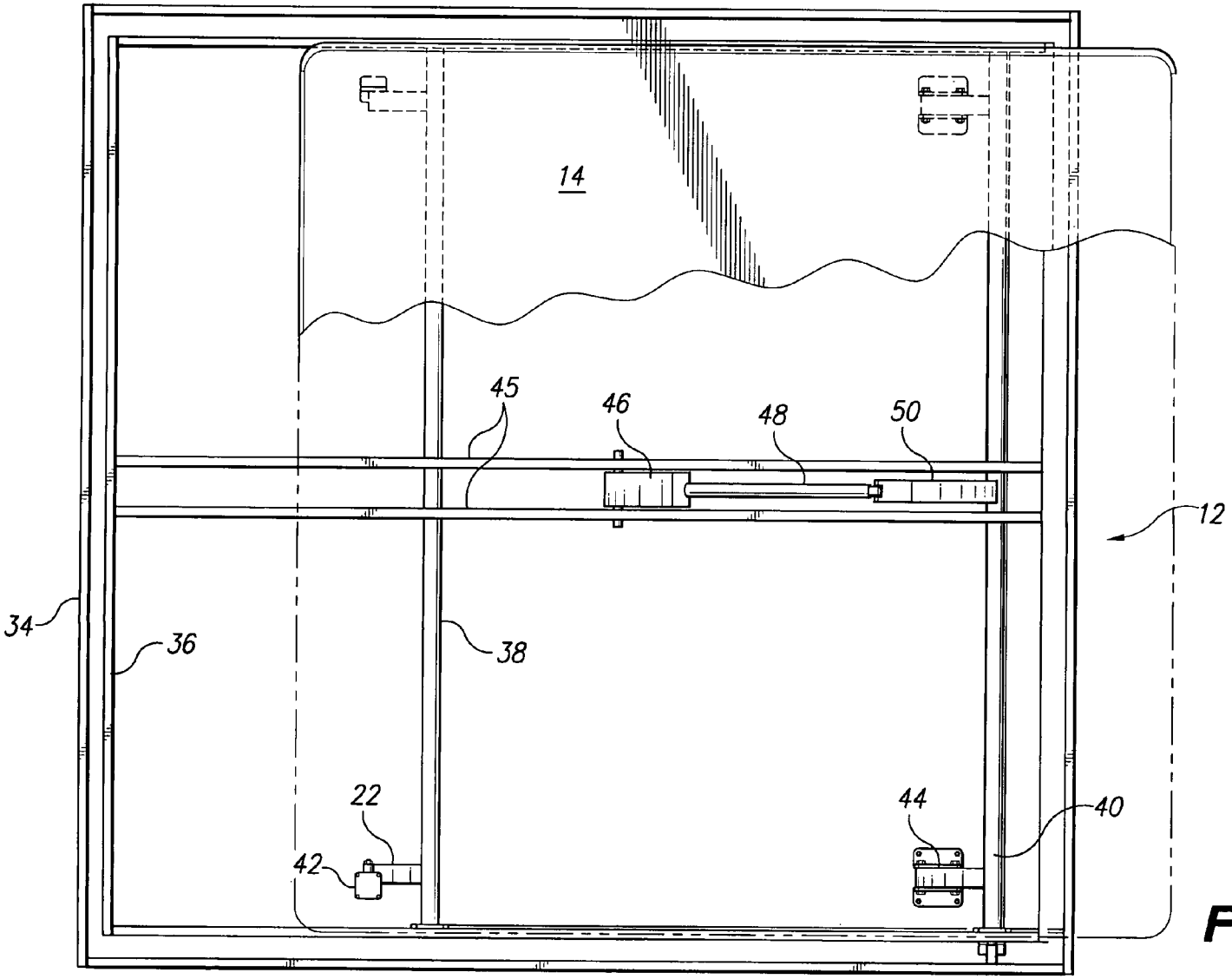
FIG. 2 is a top view of the bed with an automatic mattress lifting system according to the present invention, broken away to show details thereof.

As best shown in FIG. 2, first and second shafts 38, 40, respectively, each extend along a lateral direction within the open interior region of the frame 12. Each shaft 38, 40 is rotatably secured to the frame 12. The lower end of the first support 22 is secured to the first shaft 38 and the lower end of the second support 24 is secured to the second shaft 40.

Figure 3:
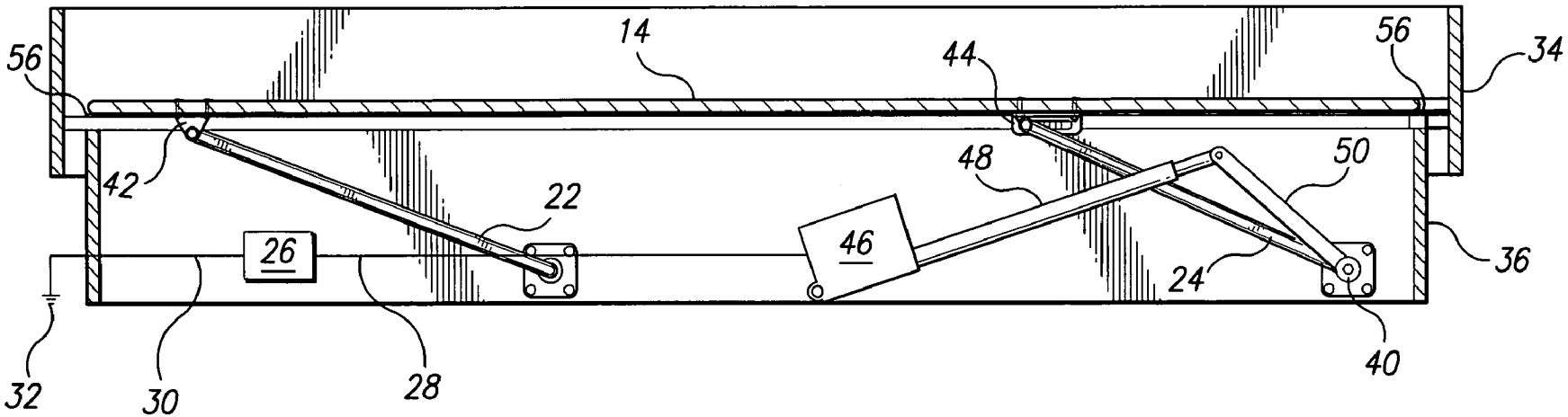
FIG. 3 is a partial side view in section of the bed with an automatic mattress lifting system according to the present invention, shown in a lowered configuration.
Figure 4:
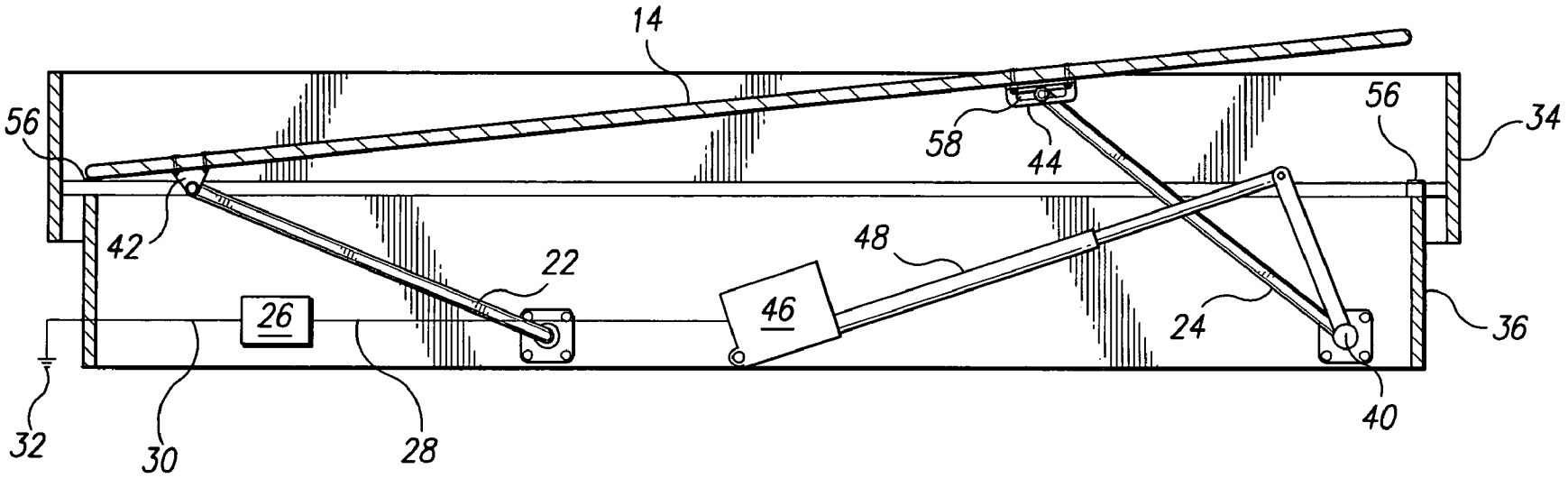
FIG. 4 is a partial side view in section of the bed with an automatic mattress lifting system according to the present invention, shown in a partially deployed configuration.
Figure 5:
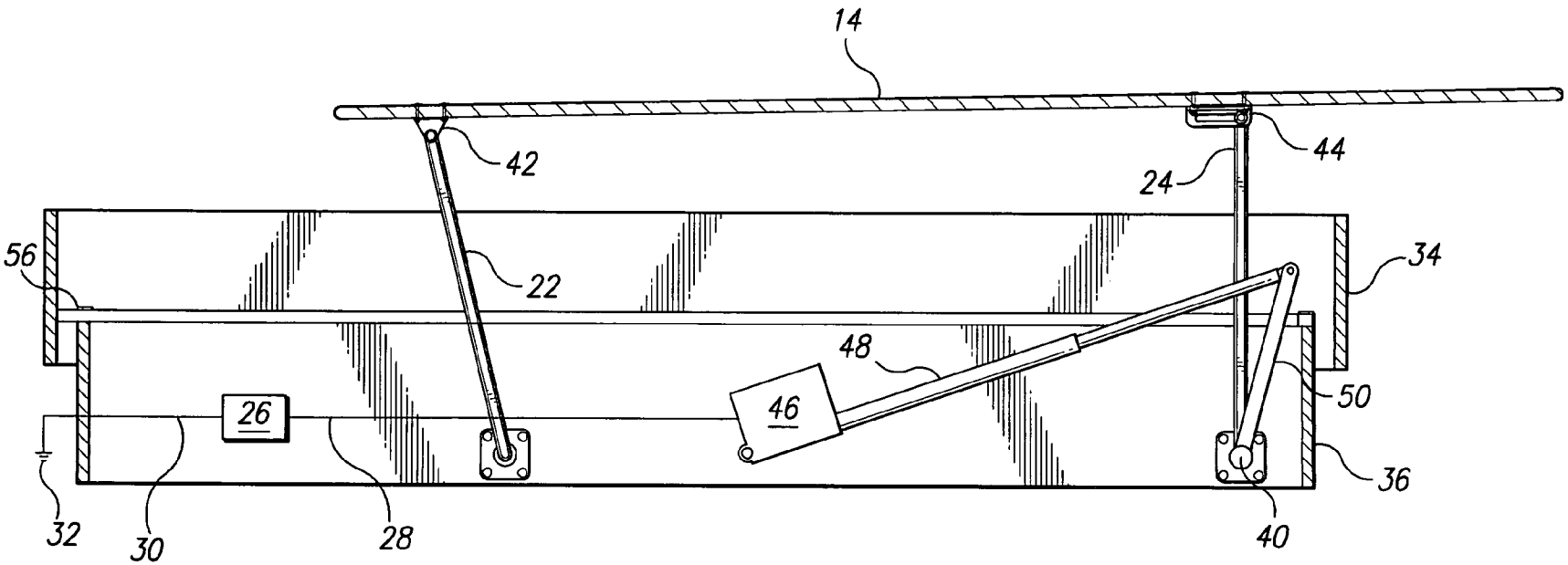
FIG. 5 is a partial side view in section of the bed with an automatic mattress lifting system according to the present invention, shown in a raised configuration.

A user-actuatable drive system 46 is mounted within the frame 12. The drive system 46 may include a motor, a linear actuator, a hydraulic drive, a pneumatic drive or the like. As best shown in FIGS. 3-5, a rod 48 is linked to the drive system 46 and is driven thereby. Preferably, there are a pair of first supports 22 and a pair of second supports 24. The pairs of first and second supports 22, 24 are respectively positioned adjacent pairs of laterally opposed ends of the first and second shafts 38, 40. The user-actuatable drive system 46 and the rod 48 are preferably positioned along a central longitudinal axis of the frame 12, substantially normal to the first and second shafts 38, 40. A controller 26 (which may include user-actuatable switches or the like) is preferably in communication with the user-actuatable drive system 46 (through control cable 28) and an external source of power 32 (through power cord 30). The user may use the controller 26 to actuate the drive system 46 to selectively raise and lower the platform 14, as will be described in greater detail below.

A lever arm 50 has opposed first and second ends. The first end is attached to the second shaft 40 and the second end is pivotally attached to the rod 48. In operation, the platform 14 begins in a lowered position, resting on the padded layer 56 within frame 12, as shown in FIG. 3. Driven motion of the rod 48 causes the lever arm 50 to rotate, thus driving rotation of the second shaft 40. Rotation of the second shaft 40 causes the pair of second supports 24 to rotate and slide or roll on platform 14, thus driving upward movement of the mattress supporting platform 14. As shown in FIG. 4, only the second supports 24 are driven, thus causing the second supports 24 to rise before the first supports 22, allowing the platform to clear the upper edge of the frame 12. Due to the pivotal connection of first supports 22, the upper ends of the second supports achieve the same vertical height as the driven second supports 24, resulting in the fully raised position shown in FIG. 5. Additionally, as shown in FIG. 2, preferably, at least one cross piece 45 is provided for adding additional support to the mattress when the mattress is in the lowered position. Cross pieces 45 extend longitudinally, from opposed ends of the bed frame.

It is to be understood that the present invention is not limited to the embodiment described above, but encompasses any and all embodiments within the scope of the following claims.

I claim:

1. A bed with an automatic mattress lifting system, comprising:

a frame defining an open interior region, the frame including an upper edge;

a mattress supporting platform having opposed upper and lower surfaces, the upper surface being sized to be substantially encompassed by the open interior region and being adapted for supporting a mattress;

at least one first support having opposed upper and lower ends, the upper end thereof being pivotally joined to the lower surface of the mattress supporting platform;

at least one second support having opposed upper and lower ends, the upper end thereof being pivotally joined to the lower surface of the mattress supporting platform;

first and second shafts extending laterally within the open interior region of the frame and being rotatably secured to the frame, the lower end of the at least one first support being attached to the first shaft and the lower end of the at least one second support being attached to the second shaft;

a user-actuatable drive;

a rod driven by the user-actuatable drive;

a lever arm having opposed first and second ends, the first end of the lever being attached to the second shaft, the second end of the lever being pivotally attached to the rod; and at least one bracket secured to the lower surface of said mattress supporting platform, the at least one bracket having a slot formed therethrough, the upper end of the at least one second support having a projecting member formed thereon, the projecting member being slidable and pivotal in the slot, wherein driven motion of the rod causes the lever arm to rotate, driving rotation of the second shaft, rotation of the second shaft causing the at least one second support to rotate, thereby driving upward movement of the mattress supporting platform whereby the platform clears the upper edge of the frame and subsequently permits the projecting member to slide in the slot resulting in a fully raised platform position.

2. The bed with an automatic mattress lifting system as recited in claim 1, wherein said frame has upper and lower portions.

3. The bed with an automatic mattress lifting system as recited in claim 2, wherein the upper portion has a lower edge extend and the lower portion has an upper edge, the lower edge of the upper portion extending beyond the upper edge of the lower portion.

4. The bed with an automatic mattress lifting system as recited in claim 3, further comprising a padded layer formed on the upper edge of the lower portion.

5. The bed with an automatic mattress lifting system as recited in claim 3, wherein the upper and lower portions are each substantially rectangular.

6. The bed with an automatic mattress lifting system as recited in claim 1, further comprising means for selectively actuating said user-actuatable drive.

7. The bed with an automatic mattress lifting system as recited in claim 1, wherein said at least one first support comprises a pair of first supports and said at least one second support comprises a pair of second supports.

8. The bed with an automatic mattress lifting system as recited in claim 7, wherein said pairs of first and second supports are positioned adjacent pairs of laterally opposed ends of said first and second shafts, respectively.

9. The bed with an automatic mattress lifting system as recited in claim 8, wherein said user-actuatable drive, said rod and said lever arm are positioned along a central longitudinal axis of said frame, substantially normal to said first and second shafts.

10. A platform bed with an automatic mattress lifting system, comprising:

a frame defining an open interior region, the frame having side surfaces and an upper edge;

a mattress;

a mattress supporting platform having opposed upper and lower surfaces, the upper surface being sized to be substantially encompassed by the open interior region and removably supporting the mattress;

at least one first support having opposed upper and lower ends, the upper end thereof being pivotally joined to the lower surface of the mattress supporting platform;

at least one second support having opposed upper and lower ends, the upper end thereof being pivotally joined to the lower surface of the mattress supporting platform;

first and second shafts extending laterally across the open interior region of the frame and being rotatably attached to the frame, the lower end of the at least one first support being attached to the first shaft and the lower end of the at least one second support being attached to the second shaft;

a user-actuatable drive;

a rod driven by the user-actuatable drive;

a lever arm having opposed first and second ends, the first end of the lever arm being attached to the second shaft, the second end of the lever arm being pivotally attached to the rod; and at least one bracket secured to the lower surface of said mattress supporting platform, the at least one bracket having a slot formed therethrough, the upper end of the at least one second support having a projecting member formed thereon, the projecting member being slidable and pivotal in the slot, wherein driven motion of the rod causes the lever arm to rotate, driving rotation of the second shaft, rotation of the second shaft causing the at least one second support to rotate, thereby driving upward movement of the mattress supporting platform whereby the platform clears the upper edge of the frame and subsequently permits the projecting member to slide in the slot resulting in a fully raised platform position.

11. The bed with an automatic mattress lifting system as recited in claim 10, wherein said frame has upper and lower portions.

12. The bed with an automatic mattress lifting system as recited in claim 11, wherein the upper portion has a lower edge and the lower portion has an upper edge, the lower of the upper portion extending beyond the upper edge of the lower portion.

13. The bed with an automatic mattress lifting system as recited in claim 12, further comprising a padded layer formed on the upper edge of the lower portion.

14. The bed with an automatic mattress lifting system as recited in claim 12, wherein the upper and lower portions are each rectangular.

15. The bed with an automatic mattress lifting system as recited in claim 10, further comprising means for selectively actuating said user-actuatable drive.

16. The bed with an automatic mattress lifting system as recited in claim 10, wherein said at least one first support comprises a pair of first supports and said at least one second support comprises a pair of second supports.

17. The bed with an automatic mattress lifting system as recited in claim 16, wherein said pairs of first and second supports are positioned adjacent pairs of laterally opposed ends of said first and second shafts, respectively.

18. The bed with an automatic mattress lifting system as recited in claim 17, wherein said user-actuatable drive, said rod, and said lever arm are positioned along a central longitudinal axis of said frame, substantially normal to said first and second shafts.

* * * * *